United States Patent [19]

Samuel

[11] 4,308,785

[45] Jan. 5, 1982

[54] BREECH MECHANISMS

[75] Inventor: Glyndwr T. Samuel, Sidcup, England

[73] Assignee: The Secretary of State for Defence in Her Britannic Majesty's Government of the United Kingdom of Great Britain and Northern Ireland, London, England

[21] Appl. No.: 112,494

[22] Filed: Jan. 16, 1980

[30] Foreign Application Priority Data

Jan. 31, 1979 [GB] United Kingdom ..... 03300/79

[51] Int. Cl.[3] ..... F41F 11/02

[52] U.S. Cl. ..... 89/4 B; 89/24; 89/26

[58] Field of Search ..... 89/167, 186, 4 B, 24, 89/26

[56] References Cited

U.S. PATENT DOCUMENTS 3,707,900 1/1973 Hornfeck et al. ..... 89/24

4,130,047 12/1978 Politzer et al. ..... 89/24

*Primary Examiner*—Stephen C. Bentley

*Assistant Examiner*—R. W. Wendtland

*Attorney, Agent, or Firm*—Pollock, Vande Sande & Priddy

[57] ABSTRACT

A sliding breech block suitable for rapid, semi-automatic operation of a bag charge gun comprises two interlinked portions mutually engageable in two dispositions at a stepped interface one of the portions being drivable in a transverse guideway by gun runout via a crank and a shaft, and the other portion being guidable by rollers engaged in cam tracks to follow a semi-arcuate path aligned at one end with the gun barrel axis and at the other with the guideway axis.

8 Claims, 4 Drawing Figures

Figure 2:
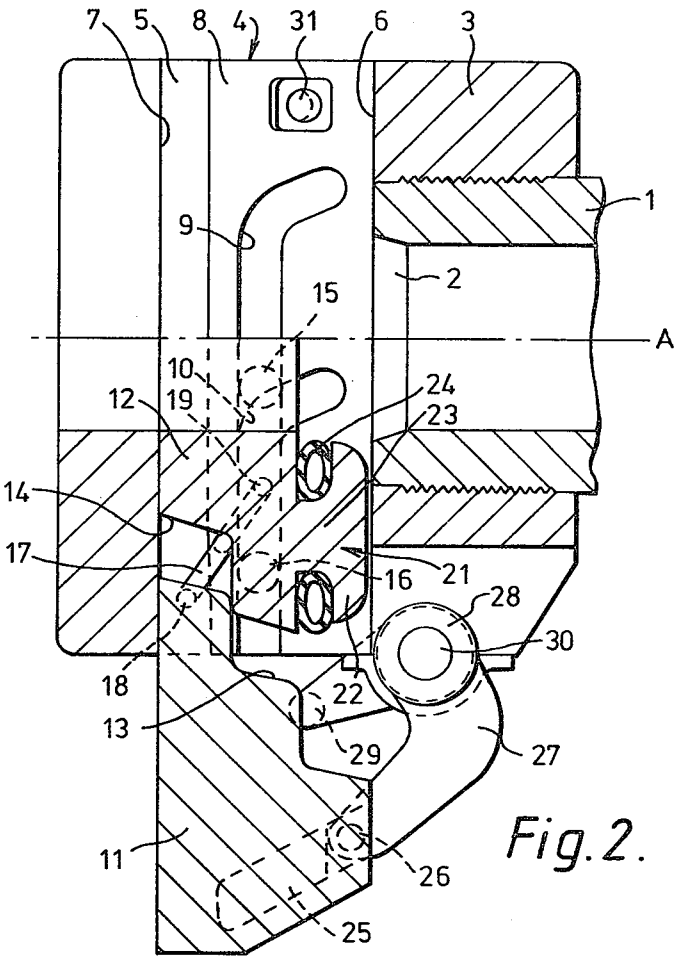

Fig. 4.
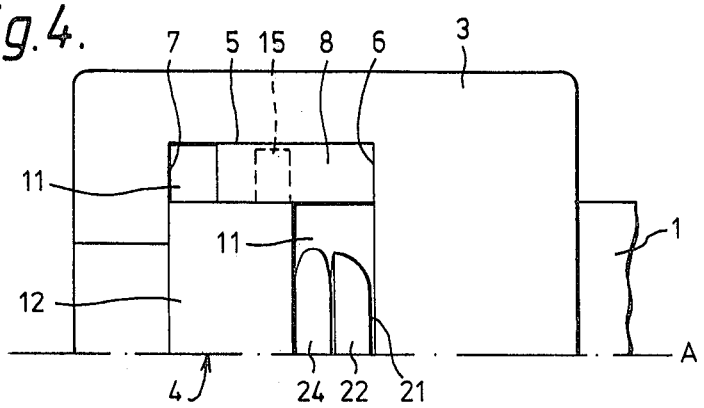
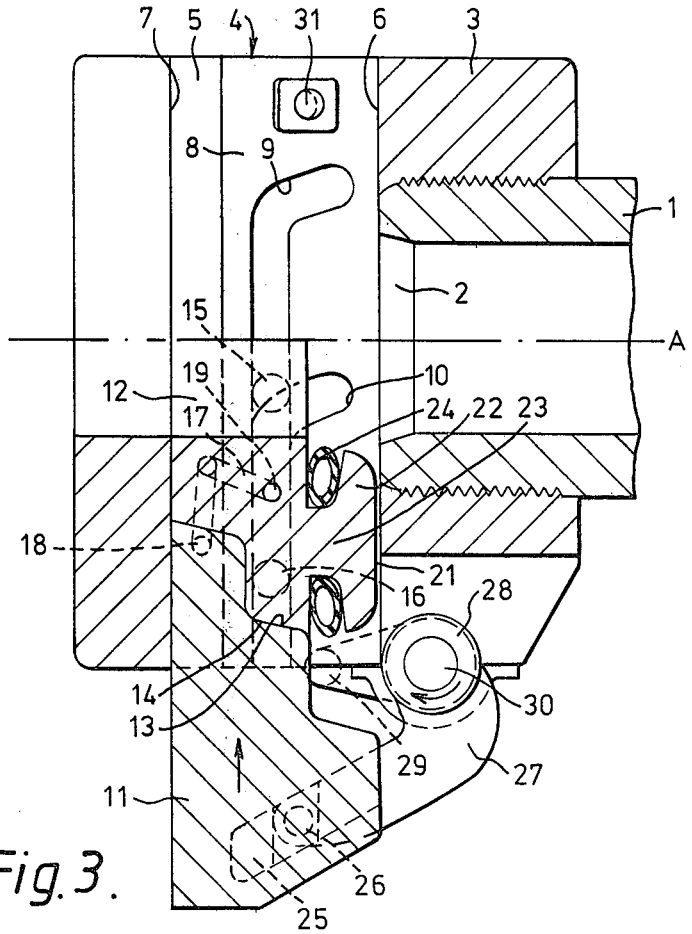
Fig. 3.

BREECH MECHANISMS

This invention relates to breech mechanisms and in particular to a mechanism having a slideable breech block suitable for semiautomatic operation of a bag charge gun.

Bag charged ammunition has advantages over cased ammunition in that no cartridge cases have to be manufactured, stowed or handled, and after firing there are no cartridge disposal problems and no residual fumes when conventional fume extraction techniques are employed.

Adequate sealing of a bag charge gun breech against the gas pressure generated on firing is normally achieved by means of a resilient pad obturator located in the breech screw, the screw and obturator being mounted on a hinged carrier which can be swung clear of the breech to permit loading, after withdrawal of the screw. The firing rates achievable with this method of loading are slow in comparison with the high rates that can be attained using known transversely sliding breech blocks commonly employed with cased ammunition, where no obturator pad is required, each inserted cartridge case acting to provide its own metal-to-metal long axial seal. Sliding blocks are capable of automatic operation and have the added advantage of being more conveniently installed in a confined space such as a tank turret.

Various attempts have been made to provide suitable sealing means which will enable a sliding block to be adapted for bag charges. For example, transversely sliding steel lipped obturators are known and used but because these have insufficient mating surface resilience to fill small imperfections caused by dirt and scratching, they are soon eroded in use by high pressure gas leakage and consequently need frequent replacement.

The present invention seeks to provide a transversely slideable mechanism which is capable of closing a breech axially so as to permit use of a conventional resilient pad obturator.

In accordance with the present invention a breech mechanism for a gun barrel having an axial breech aperture includes a guideway having an axis disposed transverse to and adjacent the breech aperture, a breech block slideable in the guideway having a drive portion and an obturator portion interlinked by at least one articulated linkage arm, which two portions are mutually engageable at a stepped interface in two distinct engagements, one being a breech open engagement and the other a breech closed engagement, differing one from the other by a one-step displacement of the interface, and cam means operative between the obturator portion and the guideway for constraining the obturator portion, when the drive portion is traversed in the guideway, to follow a part-arcuate path aligned at one end with the axis of the guideway and at the other with the axis of the gun barrel, whereby the obturator portion is caused to change from one to the other of the said two engagements with the drive portion.

The guideway may be integral with or supported upon a breech ring located on the gun barrel adjacent the breech aperture.

The obturator portion preferably includes a resilient pad disposed so as to seal the breech aperture when the obturator portion is closed axially with the gun barrel.

The cam means may conveniently comprise laterally protruding rollers attached to the obturator portion which are engaged in suitably slotted cam plates attached to the guideway.

The stepped interface preferably has a mean slope lying in a plane normal to the plane containing the axis of the gun barrel and the guideway and inclined so as to bisect the angle between these two axial directions. The steps of the interface provide a series of thrust interfaces alternately disposed to transmit thrust in the direction of the guideway axis and of the gun barrel axis and herein called the transverse thrust interfaces and the axial thrust interfaces respectively. The transverse thrust interfaces are operative whilst the drive portion is being traversed from breech open to breech closed engagement with the obturator portion, and the axial thrust interfaces are operative during breech closing and in breech closed engagement. None of the thrust interfaces are operative during breech opening, the obturator portion being drawn along the said path by the drive portion via the linkage arm.

Sliding occurs at the axial thrust interfaces during the final stages of closure and these interfaces are preferably inclined at a small taper angle to the direction of transverse sliding so as to provide a wedge action which firmly seats the obturator portion in the breech aperture, by increasingly compressing the resilient pad axially against the periphery of the aperture as the engagement area of the axial thrust interfaces increases.

The drive portion can be traversed in the guideway by a conventional drive means comprising a crank operative upon the drive portion having an actuating shaft arranged to provide automatic opening of the breech and to impart twist to a torsion bar when energised by runout of the gun after firing and recoil. Closure is achieved by releasing the twist imparted to the torsion bar during opening.

Figure 1:
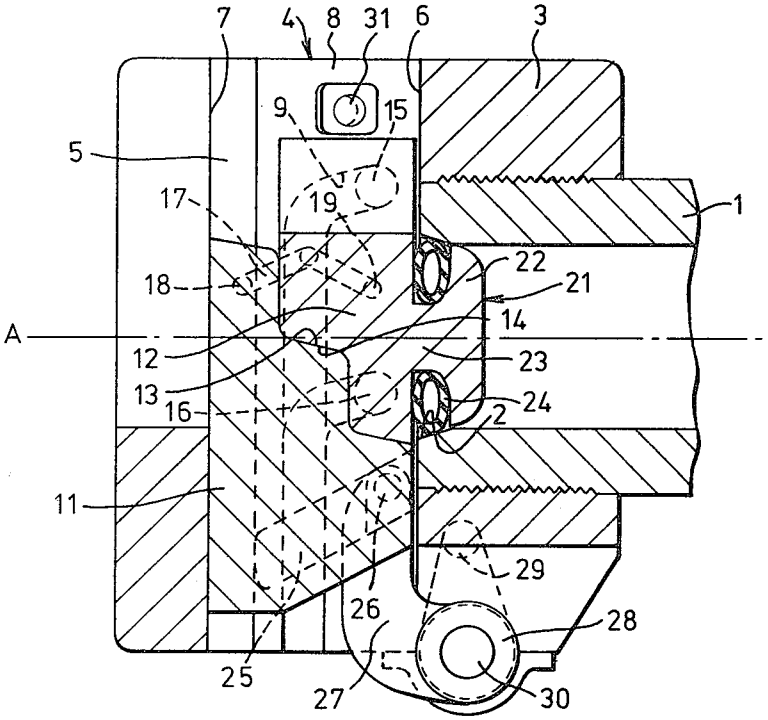

An embodiment of the invention will now be described by way of example only with reference to the accompanying drawings of which:

FIG. 1 is a view of a breech mechanism in closed condition, vertically sectioned on the axial plane of the gun barrel and the guideway, FIG. 2 is a similar view of the same breech mechanism in open condition, FIG. 3 is a similar view of the same breech mechanism at the commencement of closure, and FIG. 4 is a view from above of the half breech mechanism illustrated in FIG. 3.

The breech mechanism illustrated in FIGS. 1 to 4 includes a gun barrel 1 having an axis A, a breech aperture defined by a chamber sealing face 2 and a breech ring 3. Transversely through the breech ring 3 is a rectangular aperture comprising a guideway 4 having two side walls 5, a front wall 6 and a rear wall 7 symetrically disposed about the plane of view of FIGS. 1, 2 and 3. A cam plate 8 having cam tracks 9 and 10 is adjustably mounted on each of the two side walls 5 by means of an eccentric collet bolt 31 which permits precise location of the cam tracks with respect to the chamber sealing face 2.

A compound breech block consisting of a drive portion 11 and an obturator portion 12 having mutually engageable stepped faces 13 and 14 respectively are slideably located in the guideway 4. Portion 11 is slideable against the cam plates 8, the unshrouded portion of the side walls 5 and the rear wall 7. Portion 12 is slideable against the cam plates 8 and is provided at each side with two laterally protruding rollers 15 and 16 which locate in the cam tracks 9 and 10 respectively.

The two portions 12 and 11 are interconnected at each side by an articulated linkage arm 17 rotatably attached to each portion at pivots 18 and 19 respectively.

The obturator portion 12 has a mushroom shaped front portion (ie vent axial) 21 protrudable into the breech aperture, having a head 22 and a stalk 23 around which stalk a conventional toroidal obturating pad 24, typically of neoprene and asbestos, is fitted. An ignitor tube (not shown) is provided axially through the mushroom head and stalk which, when the breech block mechanism is closed, aligns with an electric striker (not shown) housed in the drive portion 11.

The drive portion 11 has in each side a cam track 25 which is engaged by a slide block 26 attached at one end of a crank 27, the other end of which crank is secured to a hollow actuating shaft 28 journalled on the breech ring 3. The actuating shaft 28 is arranged to be rotated in an anti-clockwise direction as viewed, by runout of the gun (interconnections not shown) so as to pull the drive portion 11 downwardly in the guideway 4, where it is held by the engagement of a spigot 29 attached to the shaft 28 with a manually releasable detent means (not shown). A torsion bar 30 is located within the shaft 28 and attached thereto at one of its ends, the other end being attached to the breech ring 3 so as to cause the torsion bar to twist when the shaft 28 is rotated. Energy thus stored in the torsion bar during runout is releasable by disengagement of the spigot 29 to turn the crank 27 clockwise and drive the drive portion 11 upwardly in the guideway 4.

Operation of the breech mechanism commencing from the closed condition of FIG. 1 is as follows:

After firing, the drive portion 11 is pulled downwards by the runout-actuated shaft 28 and crank 27. This movement initially disengages the faces 13 and 14 and causes the linkage arms 17 to pivot and extend to their maximum length, whereupon the obturator portion 12 is towed behind the drive portion by the linkage arms, first withdrawing from the breech aperture and then following a rearward and downward path defined by the constraints of the rollers 15 and 16 in the cam tracks 9 and 10.

The extent of rearward displacement corresponds to a one-step displacement of the face 14 with respect to the face 13. Downward movement of both portions continues until the fully open condition illustrated in FIG. 2 is attained, in which condition the obturator portion 12 is clear of the breech aperture and the gun barrel can be reloaded.

After reloading, the spigot 29 is released causing the drive portion 11 to be driven upwards by the crank 27. The face 13 engages with the face 14 as illustrated in FIG. 3 and the obturator portion is then pushed back along the path defined by the cam tracks 9 and 10 via the transverse thrust interfaces of the faces 13 and 14. As soon as the obturator portion 12 commences its forward movement along the cam tracks, the face 14 disengages from the face 13 at the axial thrust interfaces, and the transverse thrust interfaces commence sliding disengagement, transverse thrust action continuing at the steadily reducing areas of contact until the face 14 becomes forwardly displaced from the face 13 by one entire step, whereupon the axial thrust interfaces come into realignment and commence sliding engagement with steadily increasing area of contact.

These axial thrust interfaces are inclined at a taper angle of about 1° from the normal to the axis A in a direction providing increasing forward axial thrust as their area of engagement increases, thereby seating the obturating pad 24 firmly against the chamber sealing face 2 as the drive portion 11 closes to its fully closed engagement with the obturator portion 12 illustrated in FIG. 1. The gun is then ready for firing.

I claim

1. A breech mechanism for a gun barrel having an axial breech aperture, including:

a guideway having an axis disposed transverse to and adjacent the breech aperture, a breech block slideable in the guideway having a drive portion and an obturator portion interlinked by at least one articulated linkage arm, which two portions are mutually engageable at a stepped interface in two distinct engagements, one being a breech open engagement and the other a breech closed engagement, differing one from the other by a one-step displacement of the interface, and cam means operative between the obturator portion and the guideway for constraining the obturator portion, when the drive portion is traversed in the guideway, to follow a part-arcuate path aligned at one end with the axis of the guideway and at the other with the axis of the gun barrel, whereby the obturator portion is caused to change from one to the other of the said two engagements with the drive portion.

2. A breech mechanism as claimed in claim 1 wherein the guideway is supported upon a breech ring mounted on the gun barrel adjacent the breech aperture.

3. A breech mechanism as claimed in claim 1 wherein the obturator portion includes a resilient pad disposed so as to seal the breech aperture when the obturator portion is closed axially therewith.

4. A breech mechanism as claimed in claim 1 wherein the cam means comprises laterally protruding rollers attached to the obturator portion which are engaged in slotted cam plates attached to the guideway.

5. A breech mechanism as claimed in claim 1 wherein the stepped interface has a mean slope lying in a plane normal to a plane containing the axis of the gun barrel and the axis of the guideway, which slope is inclined to the two said axes at substantially equal angles.

6. A breech mechanism as claimed in claim 5 wherein the stepped interface comprises a plurality of transverse thrust interfaces substantially normal to the guideway axis, alternately disposed with a plurality of axial thrust interfaces substantially normal to the gun barrel axis.

7. A breech mechanism as claimed in claim 6 wherein the axial thrust interfaces are inclined outwardly from the absolute normal to the gun barrel axis in the direction of drive portion closure by a small taper angle.

8. A breech mechanism as claimed in claim 1 additionally having drive means comprising:

an actuating shaft rotatably deflectable by gun runout, having a crank operative in use to traverse the drive portion in the guideway, a torsion bar arranged so as to be twisted by deflection of the actuating shaft and releaseable detent means for maintaining the actuating shaft in the deflected condition.

* * * * *